US005963241A

United States Patent [19]

Higa et al.

[11] Patent Number: 5,963,241

[45] Date of Patent: Oct. 5, 1999

[54] THERMAL HEAD CONTROL METHOD AND DEVICE FOR MAKING A STENCIL MASTER PLATE

[75] Inventors: Ryuji Higa; Junji Takahashi; Musashi Hirata, all of Tokyo-to, Japan

[73] Assignee: Riso Kagaku Corporation, Tokyo, Japan

[21] Appl. No.: 08/886,027

[22] Filed: Jun. 30, 1997

Related U.S. Application Data

[63] Continuation of application No. 08/442,709, May 18, 1995, abandoned.

[30] Foreign Application Priority Data

May 30, 1994 [JP] Japan ..... 6-117104

[51] Int. Cl.[6] ..... B41J 2/36; B41J 2/38

[52] U.S. Cl. ..... 347/186

[58] Field of Search ..... 347/188, 186, 347/185, 194; 400/120.09, 120.14; 101/127, 128.4, 129

[56] References Cited

U.S. PATENT DOCUMENTS

| | | | |
|---|---|---|---|
| 4,432,001 | 2/1984 | Inui et al. | 347/186 |
| 4,449,136 | 5/1984 | Moriguchi et al. | 347/186 |
| 4,449,137 | 5/1984 | Inui et al. | 347/186 |
| 4,560,993 | 12/1985 | Hakoyama | 347/186 |
| 5,109,234 | 4/1992 | Otis, Jr. et al. | 347/186 |
| 5,191,357 | 3/1993 | Ono . | |
| 5,216,951 | 6/1993 | Yokoyama et al. | 347/206 |
| 5,696,547 | 12/1997 | Takeda et al. | 347/186 |

FOREIGN PATENT DOCUMENTS

| | | | |
|---|---|---|---|
| 409243 | 1/1991 | European Pat. Off. . | |
| 59-164160 | 9/1984 | Japan | 347/186 |
| 60-147359 | 8/1985 | Japan | 347/186 |
| 63-004970 | 1/1988 | Japan | 347/186 |
| 1-294068 | 11/1989 | Japan | 347/186 |
| 2-182470 | 7/1990 | Japan | 347/186 |
| 2-305660 | 12/1990 | Japan | 347/186 |
| 5-229168 | 9/1993 | Japan | 347/186 |

OTHER PUBLICATIONS

"Patent Abstracts of Japan," vol. 17, No. 181 (M–1394), Apr. 8, 1993.

"Patent Abstracts of Japan," vol.. 16, No. 510 (M–1328), Oct. 21, 1992.

*Primary Examiner*—Huan Tran

*Attorney, Agent, or Firm*—Dickstein Shapiro Morin & Oshinsky LLP

[57] ABSTRACT

In a thermal head control method for thermally making a stencil master plate from a thermal stencil master plate sheet in the manner of a dot matrix for each line and forming an independent hole for each dot, a physical quantity representing the temperature of the thermal head, such as a time interval Ti for the plate making action by the thermal head for each line and a temperature actually measured from the thermal head, is measured before the plate making action of the next line. The measured temperature is compared with a prescribed value, and if the temperature is lower than the prescribed value, the thermal head is driven (pre-heated) at a power level which is lower than the rated power output and would not affect the thermal stencil master plate sheet. The effective heat emitting property of the thermal head is made uniform without regards to other factors, and a satisfactory perforation is carried out on a thermal stencil master plate sheet at all times.

12 Claims, 3 Drawing Sheets

THERMAL HEAD CONTROL METHOD AND DEVICE FOR MAKING A STENCIL MASTER PLATE

This application is a continuation of application Ser. No. 08/442,709, filed May 18, 1995, now abandoned.

TECHNICAL FIELD

The present invention relates to a method and a device for controlling a thermal head for thermally making a stencil master plate in the manner of a dot matrix, and in particular to a method and a device for controlling a thermal head for making a stencil master plate which can perforate the stencil master plate sheet in a satisfactory fashion at all times.

BACKGROUND OF THE INVENTION

As disclosed in Japanese patent laid open publications (kokai) Nos. 2-67133 and 4-265759, it is known to carry out a dot matrix stencil master plate making process for each line and form an independent hole for each dot of the dot matrix in a thermal stencil master plate sheet. In such a process of thermally making a stencil master plate, the thermal head typically consists of an array of heat generating elements arranged in a single row in a primary scanning direction.

In such a process of thermally making a stencil master plate, it is essential for form each perforation without fail and avoid connecting adjacent perforations. To thermally perforate a stencil master plate sheet in such a satisfactory manner, a suitable amount of thermal energy is required to be transferred from the thermal head to the thermal stencil master plate sheet. However, according to the conventional thermal head for thermally making a stencil master plate, when a first line of the stencil master plate is to be prepared by selective perforation or when the time interval between two adjacent scanning cycles is excessive for instance due to the time period required for transferring data from an input end to the drive circuit for the thermal head, the temperature of the thermal head at the beginning of the plate making action may be so low that the thermal head may not be able to transfer a sufficient amount of thermal energy to the stencil master plate sheet even though the thermal head is operated at a rated power output thereof, and the thermal stencil master plate sheet may not be perforated to a sufficient extent to produce a satisfactory thermal stencil master plate. When such an unsatisfactory stencil master plate is used, the printing ink may not pass through the stencil master plate during the printing process, and the print results may become extremely poor involving thin spots. Conversely, if the rated power output is increased to avoid this problem, the temperature of the thermal head may become so high that the some of the perforations may be connected with each other, and an excessive amount of printing ink will be deposited on the printing paper.

BRIEF SUMMARY OF THE INVENTION

In view of such problems of the prior art, a primary object of the present invention is to provide a method and a device for controlling a thermal head for thermally making a stencil master plate which can always make a satisfactory stencil master plate by making perforations in the thermal stencil master plate sheet in a satisfactory manner at all times.

A second object of the present invention is to provide a method and a device for controlling a thermal head for thermally making a stencil master plate which can control the heat generating property of the thermal head in an optimum fashion with a simple arrangement.

These and other objects of the present invention can be accomplished by providing a thermal head control method for controlling a thermal head, consisting of an array of heat generating elements arranged along a primary scanning direction, for making a stencil master plate by perforating a thermal stencil master plate sheet for each line and moving the stencil master plate sheet in a secondary scanning direction relative to the thermal head in the manner of a dot matrix, comprising the steps of: measuring a physical quantity representing a temperature of the thermal head; determining if the temperature of the thermal head measured by the measuring step is lower than a prescribed value or not; driving the thermal head with a power which would not substantially affect the stencil master plate sheet if the measured temperature is lower than the prescribed value; driving the thermal head so as to form a line of the stencil master plate with a rated power; moving the stencil master plate sheet relative to the thermal head in the secondary scanning direction; and repeating the above steps for each subsequent line of the stencil master plate, and a thermal head control device for controlling a thermal head, consisting of an array of heat generating elements arranged along a primary scanning direction, for making a stencil master plate by perforating a thermal stencil master plate sheet for each line and moving the stencil master plate sheet in a secondary scanning direction relative to the thermal head in the manner of a dot matrix, comprising: measuring means for measuring a physical quantity representing a temperature of said thermal head; determining means for determining if the temperature of the thermal head measured by the measuring means is lower than a prescribed value or not; driving means for driving the thermal head so as to form each line of the stencil master plate with a rated power; and control means for pre-heating the thermal head with a power which would not substantially affect said stencil master plate sheet before driving the thermal head if the measured temperature is lower than the prescribed value.

According to the above described structure, if the thermal head temperature is excessively low when a plate making action is about to be started, for instance, because the time interval between successive steps of forming each line of the stencil master plate is excessive, the thermal head is preheated at a power level which is lower than a rated power output and would not substantially affect the thermal stencil master plate sheet so that the thermal head temperature is appropriately compensated. As a result, a satisfactory perforation is carried out on a thermal stencil master plate sheet at all times.

The physical quantity may consist of a temperature measured from the thermal head, or a time period between a previous step of forming a line of the stencil master plate with a rated power to a next one. To compensate for variations in external parameters such as the ambient temperature, and the kind of the stencil master plate sheet, the prescribed value may be varied depending on the changes in these parameters.

Also, to achieve a uniform temperature distribution among the heat generating elements of the thermal head, the step of driving the thermal head with the rated power may be followed by a step of driving the thermal head with a drive signal consisting of reversed data of the data for the single line or driving those heat generating elements which were not heated in the previous driving step at a power level which is lower than the rated power output and would not affect the thermal stencil master plate sheet.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
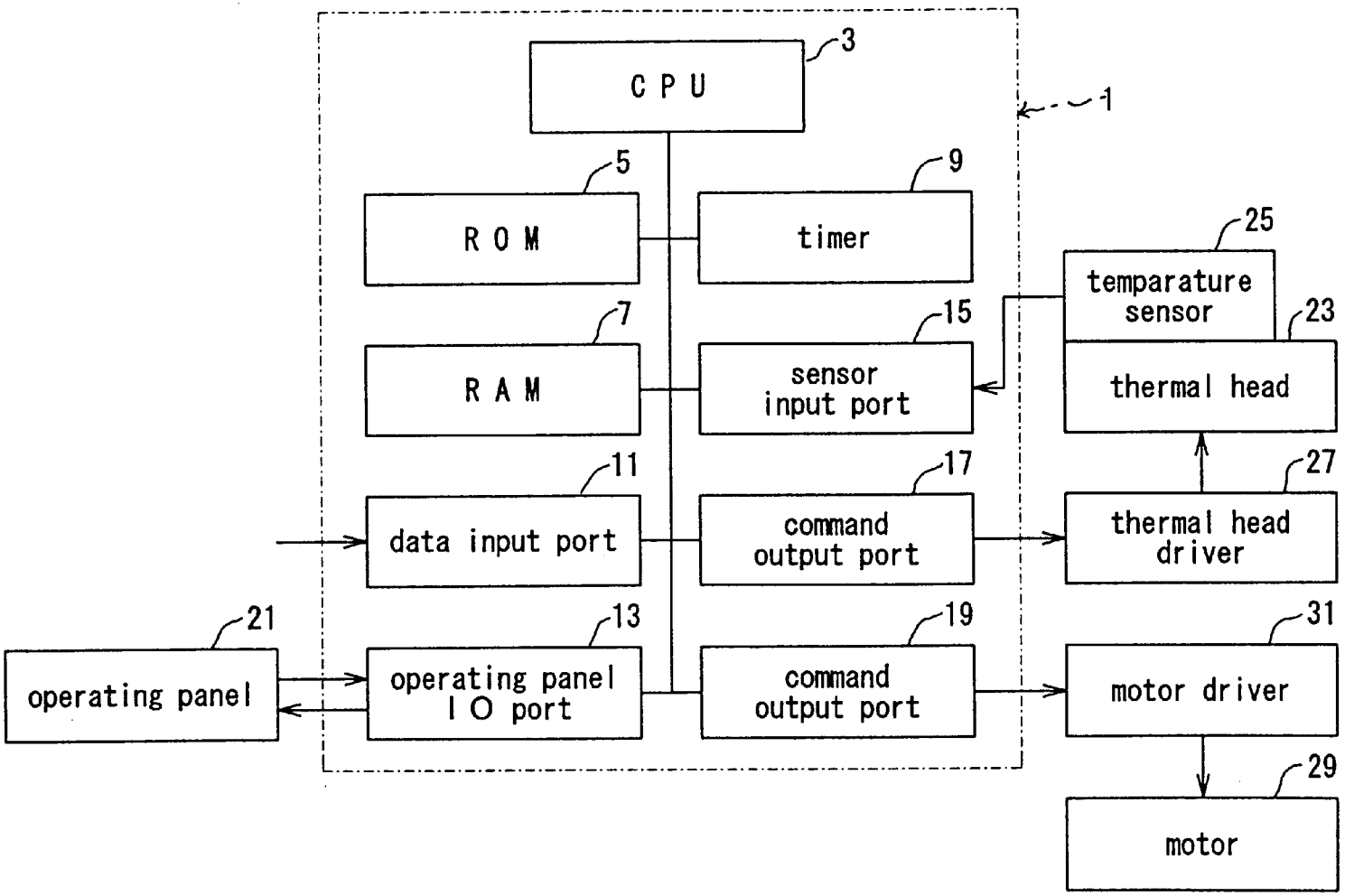
FIG. 1 is a block diagram showing a first embodiment of the thermal head control device for thermally making a stencil master plate.

FIG. 1 shows an overall structure of the thermal head control device for thermally making a stencil master plate which is common to a first embodiment and a second embodiment of the present invention. This control device essentially consists of a one-chip microcomputer 1 which comprises a CPU 3, ROM 5 for storing system programs, RAM 7 for temporarily storing various data, a timer 9, a parallel input port 11 for data input, an operating panel IO port 13, a sensor input port 15, and command signal output ports 17 and 19.

The parallel input port 11 for data input receives original image data read by an image scanner or the like. The operating panel IO port 13 is connected to an operating panel 21 provided with various input keys and an LCD panel. The sensor input 15 is connected to a temperature sensor 25 attached to a thermal head 23 in the case of the second embodiment of the present invention as described hereinafter. The command signal output port 17 is connected to a thermal head driver 27 for driving or heating the thermal head 23. The other command signal output port 19 is connected to a motor driver 31 for a motor 29 for moving the stencil master plate sheet in the secondary scanning direction.

The thermal head 23 consists of an array of heat generating elements (not shown in the drawings) arranged in a single row along the primary scanning direction, and performs a plate making action in the manner of a dot matrix by thermally forming an independent hole for each dot in a stencil master plate sheet sequentially for each line by selectively activating the heat generating elements. As described hereinafter, according to the second embodiment of the present invention, the thermal head 23 is incorporated with the temperature sensor 25 consisting of a thermistor or the like which measures the temperature of the thermal head 23.

According to the first embodiment of the thermal head control method for thermally making a stencil master plate of the present invention, the time interval of the plate making action by the thermal head 23 between successive plate making actions of the preceding line and the next line is measured by the timer 9, and this time interval is determined to be longer than a prescribed time interval or not by the CPU 3 executing a system program. If the measured time interval is determined to be equal to or longer than the prescribed time interval, a command signal for driving all the heat generating elements of the thermal head at a power level which is lower than a rated power output and would not substantially affect the thermal stencil master plate sheet is forwarded from the command signal output port 17 to the thermal head driver 27.

As a result, the thermal head driver 27 drives all of the heat generating elements of the thermal head 23 at a power level which is lower than the rated power output and would not affect the thermal stencil master plate sheet.

Figure 2:
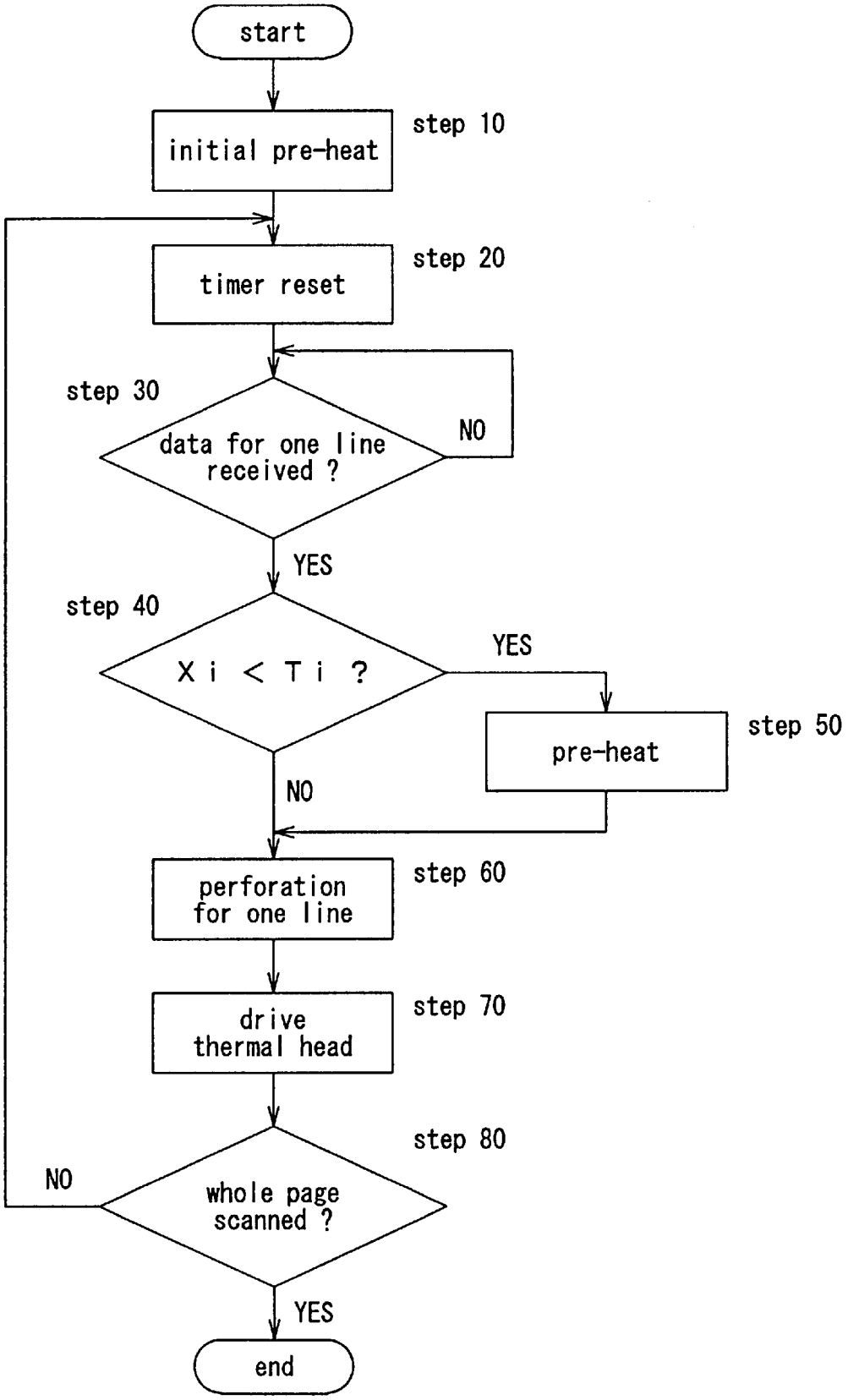
FIG. 2 is a flow chart showing the control action of a first embodiment of the thermal head control method for thermally making a stencil master plate.

FIG. 2 shows the control flow of the operation of the first embodiment. Before starting a first plate making action, the thermal head 23 is driven at a power level which is lower than the rated power output and would not affect the thermal stencil master plate sheet. In other words, an initial pre-heating step is carried out (step 10).

Then, the timer 9 is cleared, and starts measuring the elapsed time (step 20). This step of time measurement is continued until all the data for a single line has been received (step 30). The value of the measured time interval Ti is compared with a reference value Xi (step 40). If Xi<Ti, a pre-heating step is carried out and all of the heat generating elements of the thermal head 23 is driven at a power level which is lower than the rated power output and would not substantially affect the thermal stencil master plate sheet (step 50).

A drive signal corresponding to the data for a single line is forwarded to the thermal head driver 27, and the thermal head 23 is driven at the rated power output (step 60). As a result, the stencil master plate sheet is thermally perforated so as to form a single line of the stencil master plate. The reference value Xi may be selected appropriately depending on the ambient temperature, the kind of the stencil master plate sheet and other factors.

After this step of driving the thermal head 23 at the rated power output has been completed, the thermal head 23 is driven by a drive signal consisting of reversed data of the data for the single line or driving those heat generating elements which were not heated in the previous driving step at a power level which is lower than the rated power output and would not affect the thermal stencil master plate sheet (step 70). As a result, the temperature distribution of the heat generating elements of the thermal head 23 is made uniform.

Then, it is determined if the plate making process for the first original copy has been completed or not (step 80), and the above described steps are carried out until the plate making process for the first original copy has been completed.

According to the second embodiment of the thermal head control method for thermally making a stencil master plate of the present invention, the temperature information on the thermal head 23 measured by the temperature sensor 25 is received by the sensor input port 15, and it is determined by the CPU 3 executing a system program if the thermal head temperature is lower than the prescribed value. If the thermal head temperature is determined to be equal to or lower than the prescribed value, a command signal for driving all the heat generating elements of the thermal head 23 at a power level which is lower than the rated power output and would not substantially affect the thermal stencil master plate sheet is forwarded from the command signal output port 17 to the thermal head driver 27.

As a result, the thermal head driver 27 drives all of the heat generating elements of the thermal head 23 at a power level which is lower than the rated power output and would not affect the thermal stencil master plate sheet.

Figure 3:
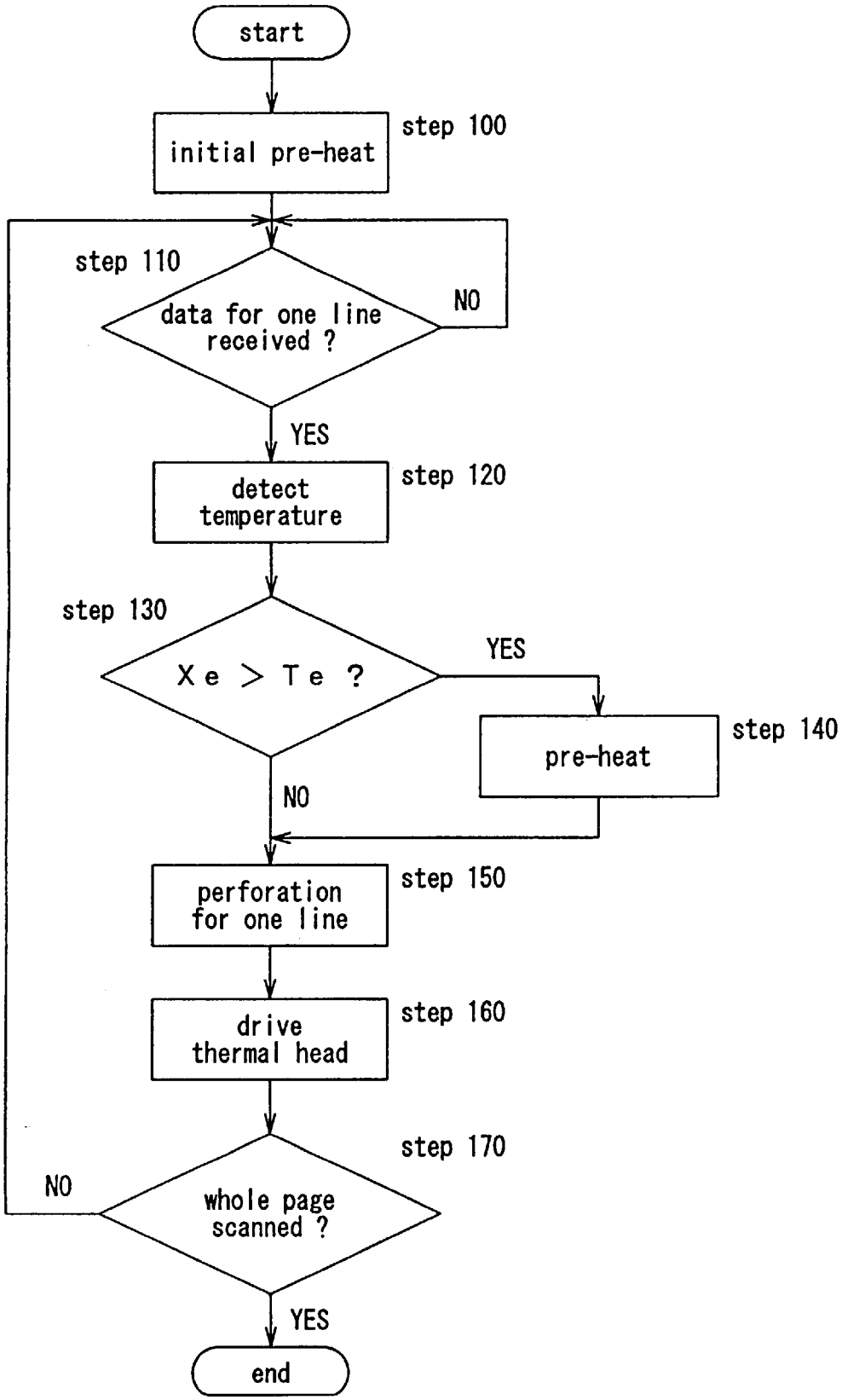
FIG. 3 is a flow chart showing the control action of a second embodiment of the thermal head control method for thermally making a stencil master plate.

FIG. 3 shows the control flow of the operation of the above described second embodiment. Before starting a first plate making action, the thermal head 23 is driven at a power level which is lower than the rated power output and would not affect the thermal stencil master plate sheet. In other words, an initial pre-heating step is carried out (step 100).

Then, it is determined if the data for a single line has been received (step 110), and if the data for a single line has been fully received, the thermal head temperature Te detected by the temperature sensor 25 is supplied to the CPU (step 120).

Then, the thermal head temperature Te is compared with a reference value Xe (step 130). If Te<Xe, a pre-heating step is carried out and all of the heat generating elements of the thermal head 23 are driven at a power level which is lower than the rated power output and would not affect the thermal stencil master plate sheet (step 140).

Thereafter, a drive signal corresponding to the data for a single line is forwarded to the thermal head driver 27, and the thermal head 23 is driven at the rated power output (step 150). As a result, the stencil master plate sheet is thermally perforated so as to form a single line of the stencil master plate. The reference value Xe may be selected appropriately depending on the ambient temperature, the kind of the stencil master plate sheet and other factors.

After this step of driving the thermal head 23 at the rated power output has been completed, the thermal head 23 is driven by a drive signal consisting of reversed data of the data for a single line or driving those heat generating elements which were not heated in the previous driving step at a power level which is lower than the rated power output and would not affect the thermal stencil master plate sheet (step 160). As a result, the temperature distribution of the heat generating elements of the thermal head 23 is made uniform.

Then, it is determined if the plate making process for the first original copy has been completed or not (step 170), and the above described steps are carried out until the plate making process for the first original copy has been completed.

Thus, as can be understood from the above description, according to the thermal head control method and device of the present invention, when the thermal head temperature is relatively low for instance because the time interval between the plate making action of one line to that of the next line is long, the thermal head is driven at a power level which is lower than the rated power output and would not affect the thermal stencil master plate sheet, and the thermal head temperature is compensated before starting the plate making action for the next line. Thereby, the thermal head temperature at the start of the plate making action for each line can be made uniform without regards to the time interval between the plate making action of one line to that of the next line, and a satisfactory plate making action accompanied by appropriate thermal perforation can be accomplished.

Although the present invention has been described in terms of preferred embodiments thereof, it is obvious to a person skilled in the art that various alterations and modifications are possible without departing from the scope of the present invention which is set forth in the appended claims.

What we claim is:

1. A thermal head control method for controlling a thermal head, consisting of an array of heat generating elements arranged along a primary scanning direction, for making a stencil master plate by perforating a thermal stencil master plate sheet for each line and moving said stencil master plate sheet in a secondary scanning direction relative to said thermal head in the manner of a dot matrix, comprising the steps of:

measuring a physical quantity representing a temperature of said thermal head;

determining if the representative temperature of said thermal head measured by said measuring step is lower than a prescribed value or not;

driving said thermal head with a power which would not substantially affect said stencil master plate sheet if said representative temperature is lower than said prescribed value;

perforating said stencil master plate sheet to form a line of said stencil master plate by driving said thermal head with a rated power;

moving said stencil master plate sheet relative to said thermal head in said secondary scanning direction; and repeating the above steps for each subsequent line of said stencil master plate.

2. A thermal head control method according to claim 1, wherein said physical quantity comprises a time period between a previous step of forming a line of said stencil master plate with a rated power and a next one.

3. A thermal head control method according to claim 1, wherein said physical quantity comprises a temperature measured from said thermal head.

4. A thermal head control device for controlling a thermal head, consisting of an array of heat generating elements arranged along a primary scanning direction, for making a stencil master plate by perforating a thermal stencil master plate sheet for each line and moving said stencil master plate sheet in a secondary scanning direction relative to said thermal head in the manner of a dot matrix, comprising:

measuring means for measuring a physical quantity representing a temperature of said thermal head;

determining means for determining if the representative temperature of said thermal head measured by said measuring means is lower than a prescribed value or not; and control means for driving said thermal head with a rated power so as to perforate said stencil master plate sheet to form each line of said stencil master plate if said representative temperature is greater than or equal to said prescribed value and for pre-heating said thermal head with a power which would not substantially affect said stencil master plate sheet before driving said thermal head if said representative temperature is lower than said prescribed value.

5. A thermal head control device according to claim 4, wherein said measuring means comprises a temperature sensor attached to said thermal head.

6. A thermal head control device according to claim 4, wherein said measuring means comprises a timer for measuring a time period between a previous step of forming a line of said stencil master plate with a rated power and a next one.

7. A thermal head control device according to claim 4, wherein said control means, after driving said thermal head with a rated power, further drives those heat generating elements which were not heated for a preceding line with a power which would not substantially affect said stencil master plate sheet.

8. A thermal head control device according to claim 4, wherein said physical quantity comprises a temperature measured from said thermal head.

9. A thermal head control device according to claim 4, wherein said prescribed value is varied in accordance with the kind of stencil master plate sheet which is being perforated.

10. A thermal head control method for controlling a thermal head, consisting of an array of heat generating elements arranged along a primary scanning direction, for making a stencil master plate by perforating a thermal stencil master plate sheet for each line and moving said stencil master plate sheet in a secondary scanning direction relative to said thermal head in the manner of a dot matrix, comprising the steps of:

(a) measuring a physical quantity representing a temperature of said thermal head;

(b) determining if the representative temperature of said thermal head measured by said measuring step (a) is lower than a prescribed value or not;

(c) driving said thermal head with power which would not substantially affect said stencil master plate sheet if said representative temperature is lower than said prescribed value;

(d) perforating said stencil master plate sheet to form a line of said stencil master plate by driving said thermal head with a rated power;

(e) driving those heat generating elements which were not heated in said previous perforating step (d) with a power which would not substantially affect said stencil master plate sheet;

(f) moving said stencil master plate sheet relative to said thermal head in said secondary scanning direction; and (g) repeating the above steps (a)–(f) for each subsequent line of said stencil master plate.

11. A thermal head control method for controlling a thermal head, consisting of an array of heat generating elements arranged along a primary scanning direction, for making a stencil master plate by perforating a thermal stencil master plate sheet for each line and moving said stencil master plate sheet in a secondary scanning direction relative to said thermal head in the manner of a dot matrix, comprising the steps of:

measuring a physical quantity representing a temperature of said thermal head;

determining if the representative temperature of said thermal head measured by said measuring step is lower than a prescribed value or not, wherein said prescribed value is varied depending on an ambient temperature;

driving said thermal head with power which would not substantially affect said stencil master plate sheet if said representative temperature is lower than said prescribed value;

perforating said stencil master plate sheet to form a line of said stencil master plate by driving said thermal head with a rated power;

moving said stencil master plate sheet relative to said thermal head in said secondary scanning direction; and repeating the above steps for each subsequent line of said stencil master plate.

12. A thermal head control method for controlling a thermal head, consisting of an array of heat generating elements arranged along a primary scanning direction, for making a stencil master plate by perforating a thermal stencil master plate sheet for each line and moving said stencil master plate sheet in a secondary scanning direction relative to said thermal head in the manner of a dot matrix, comprising the steps of:

measuring a physical quantity representing a temperature of said thermal head;

determining if the representative temperature of said thermal head measured by said measuring step is lower than a prescribed value or not, wherein said prescribed value is varied depending on the kind of said stencil master plate sheet;

driving said thermal head with power which would not substantially affect said stencil master plate sheet if said representative temperature is lower than said prescribed value;

perforating said stencil master plate sheet to form a line of said stencil master plate by driving said thermal head with a rated power;

moving said stencil master plate sheet relative to said thermal head in said secondary scanning direction; and repeating the above steps for each subsequent line of said stencil master plate.

* * * * *